US005725403A

United States Patent [19]

Ridolfo

[11] Patent Number: 5,725,403

[45] Date of Patent: Mar. 10, 1998

[54] MARINE OUTBOARD MOTOR FLUSH AND RUN TANK AND METHOD OF FLUSHING A MARINE OUTBOARD MOTOR

[76] Inventor: James T. Ridolfo, 144 Portland St., New Orleans, La. 70124

[21] Appl. No.: 751,502

[22] Filed: Nov. 18, 1996

[51] Int. Cl.[6] ..... B63H 20/30

[52] U.S. Cl. ..... 440/88; 134/22.14; 134/117; 134/169 A; 134/182; 440/113

[58] Field of Search ..... 440/88, 113; 134/166 R, 134/169 A, 182, 117, 22.11, 22.1, 22.14, 22.19, 23

[56] References Cited

U.S. PATENT DOCUMENTS

| | | | |
|---|---|---|---|
| 2,620,812 | 12/1952 | Kiefer | 134/182 |
| 4,065,325 | 12/1977 | Maloney | 134/167 |
| 4,121,948 | 10/1978 | Guhlin | 440/88 |
| 4,869,695 | 9/1989 | Sajdak, Jr. | 440/88 |
| 5,337,774 | 8/1994 | Boyd | 137/1 |
| 5,385,613 | 1/1995 | Coleman | 134/22.14 |
| 5,482,483 | 1/1996 | Rice | 440/88 |

*Primary Examiner*—Sherman Basinger
*Attorney, Agent, or Firm*—Joseph N. Breaux

[57] ABSTRACT

A method of flushing an outboard marine motor using a marine outboard motor flush and run tank wherein the marine outboard motor flush and run tank comprises a flush trough member, a fluid inlet and a fluid outlet. The method of flushing an outboard marine motor flushes from the coolant system of an outboard marine motor salt, silt and other material. An organic detergent is added to fresh water for forming a mixture which is siphoned into the coolant system for breaking down and purging the salt, silt and other material from the coolant system.

12 Claims, 3 Drawing Sheets

MARINE OUTBOARD MOTOR FLUSH AND RUN TANK AND METHOD OF FLUSHING A MARINE OUTBOARD MOTOR

TECHNICAL FIELD

The present invention relates to method of flushing a marine outboard motor and a marine outboard motor flush and run tank and, more particularly, to a method for flushing a marine outboard motor of salt, silt and other materials for maintaining the marine outboard motor and extending the useful life of the marine outboard motor. Additionally, the present invention is directed to a marine outboard motor flush and run tank for carrying out said method of the present invention.

BACKGROUND OF THE INVENTION

Marine outboard motors are commonly used in salt or brackish water. Henceforth, the coolant system of the marine outboard motors must be repeatedly cleaned for maintaining the marine outboard motors and extending the useful life thereof. The salt of salt water corrodes the coolant system of the marine outboard motor and eventually renders the marine outboard motor inoperable. After the marine outboard motors are drained of the salt or brackish water a significant amount of residue consisting of salt and silt builds up within the coolant system.

Several apparatuses have been patented which are aimed at flushing marine motors.

U.S. Pat. No. 4,065,325, by Maloney, is directed to an adaptable flush attachment for marine engines.

U.S. Pat. No. 4,869,695, by Sajdak, Jr., is directed to a boot apparatus wherein the propeller is submerged therein. The apparatus, by Sajdak, Jr., flushes the coolant system with fresh water from a faucet. The apparatus, by Sajdak, Jr., does not suggest using an organic detergent mixed with fresh water for throughly cleaning the marine motor as does the present invention.

U.S. Pat. No. 5,482,483, by Rice, is directed to a portable reservoir for flushing a marine motor. The reservoir, by Rice, is not directed to using an organic detergent mixed with fresh water for throughly cleaning the marine motor, as does the present invention.

U.S. Pat. No. 5,337,774, by Boyd, is directed to marine motor maintenance. However the system, by Boyd, is complex and expensive requiring pumps for pumping the fluid of the system. Furthermore, the system, by Boyd, is directed to winterizing and dewinterizing marine motors and requires antifreeze.

SUMMARY OF THE INVENTION

The preferred embodiment of the method for flushing a marine outboard motor and marine outboard motor flush and run tank of the present invention solves the aforementioned problems in a straight forward and simple manner. What is provided is a method for flushing a marine outboard motor of salt, silt and other materials for maintaining the marine outboard motor and extending the useful life of the marine outboard motor. Also provided is a marine outboard motor flush and run tank for carrying out said method of the present invention.

In particular, a method of flushing an outboard marine motor uses the marine outboard motor flush and run tank wherein the marine outboard motor flush and run tank comprises a flush trough member, fluid inlet means and fluid outlet means. The method of flushing an outboard marine motor comprises the steps of:

(a) placing a propeller member of the outboard marine motor into the confines of the fluid trough member;

(b) coupling a fluid line to the fluid inlet means;

(c) coupling a cap member to the fluid outlet means;

(d) pouring an organic detergent into the fluid trough member;

(e) filling the fluid trough member with fresh water via the coupled fluid line;

(f) starting said outboard marine motor;

(g) siphoning a mixture of said organic detergent and said fresh water into a coolant system of said outboard marine motor;

(h) purging said mixture from said coolant system into said fluid trough member;

(I) inspecting the purged mixture for salt, silt and other material;

(j) opening the fluid outlet means;

(k) flushing from the fluid outlet means the purged mixture having salt, silt and other material mixed therein;

(l) simultaneous to step (k), replenishing the fresh water in the flush trough member;

(m) maintaining a water level at a preferred level in the flush trough member;

(n) monitoring the mixture for the salt, the silt and the other material until the fresh water is substantially clear; and (o) repeating steps (g)–(n) until the mixture is substantially clear.

In view of the above, an object of the invention is to provide a method of flushing a marine outboard motor that throughly cleans salt, silt and other material by using an organic detergent in a fresh water supply wherein the organic detergent enhances the breakdown of salt, silt and other material. Breaking down the salt, silt and other material via the organic detergent maximizes the effectiveness of the flushing process.

A further object of the invention is to provide a method of flushing a marine outboard motor that significantly reduces corrosion and buildup of salt, silt and other material in a marine outboard motor.

It is a still further object of the invention to provide a marine outboard motor flush and run tank which is easy to use for carrying out the method of the present invention, inexpensive and easily manufactured.

The above objects and other features of the present invention will become apparent from the drawings, the description given herein, and the appended claims.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
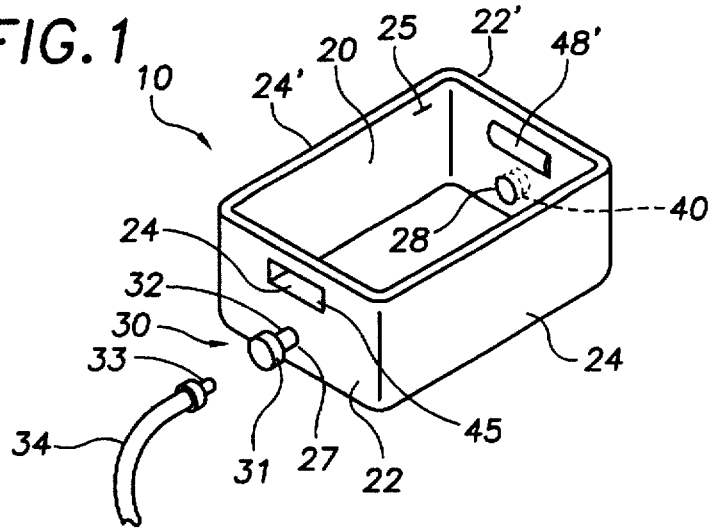
FIG. 1 illustrated a front perspective view of the present invention.
Figure 2:
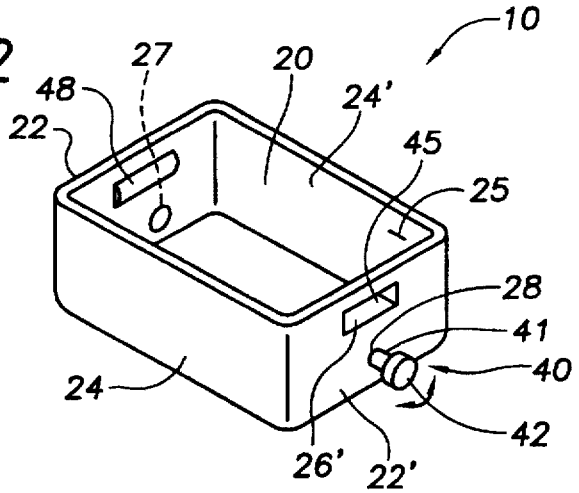
FIG. 2 illustrates a back perspective view of the present invention.

Referring now to the drawings, and in particular FIGS. 1 and 2, a front and back perspective view, respectively, of the marine outboard motor flush and run tank of the present invention is illustrated for carrying out the method of flushing a marine outboard motor. The marine outboard motor flush and run tank is designated generally by the numeral 10. Marine outboard motor flush and run tank 10 is comprised of flush trough member 20, fluid inlet means 30 and fluid outlet means 40 and carry transport means 45.

Figure 3:
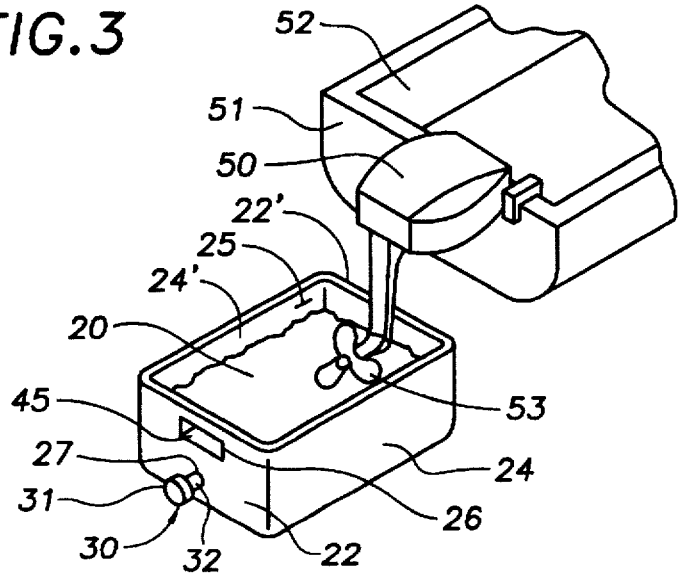
FIG. 3 illustrates a perspective view of the present invention deployed in use.

Flush trough member 20 is a rectangular shaped housing comprising two short wall surfaces 22 and 22' and two long wall surfaces 24 and 24' wherein the two short wall 22 and 22' are unitarily couple with the two long wall surfaces 24 and 24' thereby forming said rectangular shaped housing. Flush trough member 20 has predetermined level marker 25 located on the interior surface of long wall surface 24' wherein the predetermined level marker 25 marks the preferred amount of water required for flushing marine outboard motor 50 (FIG. 3). In the exemplary embodiment, flush trough member 20 is made of polyethylene plastic or the like.

Short wall surface 22 has formed in the center of the lower portion thereof inlet port aperture 27. Short wall surface 22' has formed in the center of the lower portion thereof outlet port aperture 28. Short wall surfaces 22 and 22', respectively, each have formed in the center top portion thereof recesses 26 and 26', respectively.

Fluid inlet means 30 comprises female coupler 31 and fluid inlet conduit 32. One distal end of fluid inlet conduit 32 unitarily couples to female coupler 31. Female coupler 31 is threaded for connection to male coupler 33 of a fluid line 34 such as a standard garden hose or the like. The other distal end of fluid inlet conduit 32 couples to inlet port aperture 27 formed in short wall surface 22. Fluid inlet conduit 32 may be unitarily coupled to short wall surface 22 or, alternatively, may be threaded for mating connection with threads formed in inlet port aperture 27.

Fluid outlet means 40 comprises fluid outlet conduit 41 and cap member 42. One distal end of fluid outlet conduit 41 couples to outlet port aperture 28 formed in short wall surface 22'. Fluid outlet conduit 41 may be unitarily coupled to short wall surface 22' or, alternatively, may be threaded for mating connection with threads formed in outlet port aperture 28. The other distal end of fluid outlet conduit 41 is threaded for mating connection with cap member 42.

The interior of fluid outlet conduit 41 is narrow such that, when the cap member 42 is removed, the water which exits from fluid outlet conduit 41 exits at a rate slower than the fill rate thereby maintaining the water in flush trough member 20 at predetermined level marker 25.

Carry transport means 45 comprises back wall surfaces 48 and 48', respectively, which are slightly concave hollow members. Back wall surfaces 48 and 48', respectively, unitarily couple to the outer perimeter of recesses 26 and 26', respectively, thereby facilitating mobility of motor flush and run tank 10 when a user or marine motor mechanic places his or her hands into recesses 26 and 26' and picks up motor flush and run tank 10.

Figure 4A:
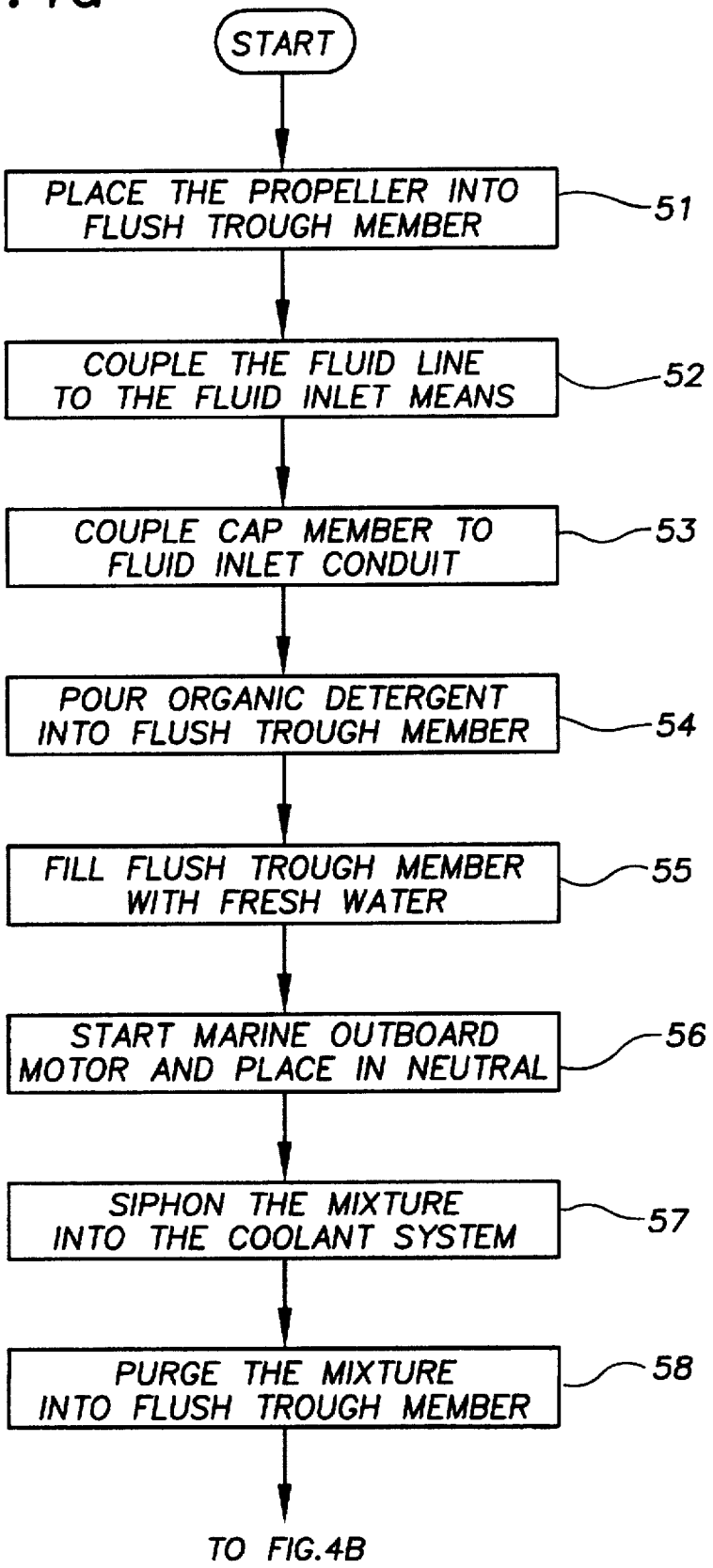
FIGS. 4*a* and 4*b* illustrate a flow chart of the method of the present invention.
Figure 4B:
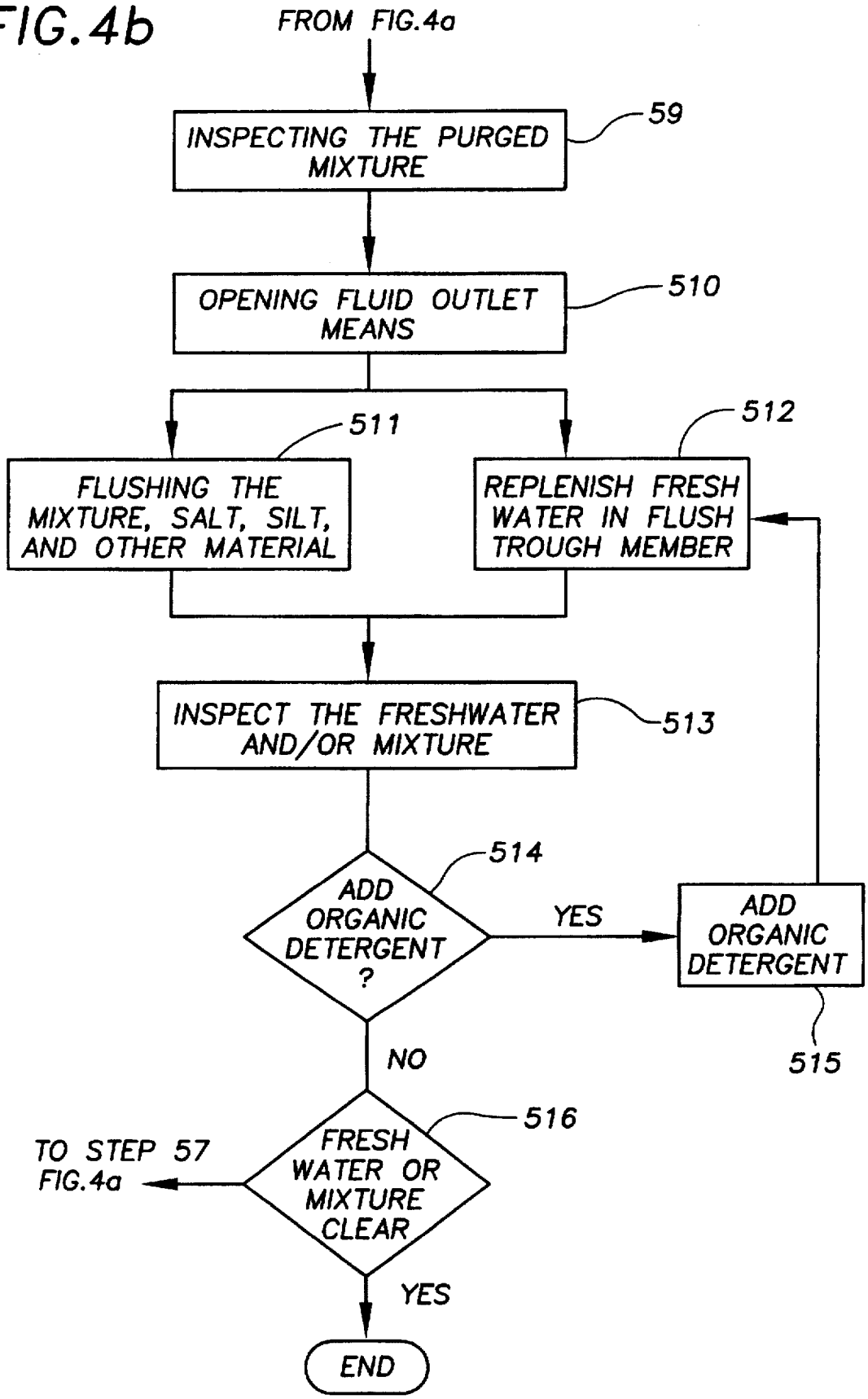

The following description will be directed to the method of flushing the marine outboard motor of the present invention. Referring to FIGS. 3, 4*a* and 4*b* , the method of the present invention may be carried out when marine outboard motor 50 is secured to stern 51 of watercraft 52 wherein watercraft 52 may be in a waterway or on a watercraft trailer (not shown). Moreover, the method of the present invention may be carried out when marine outboard motor 50 is supported in a repair shop. Carry transport means 45 allows marine outboard motor flush and run tank 10 to be transported. Henceforth, the method of the present invention can be performed anywhere a fresh water supply is available.

The method of the present invention is carried out using the marine outboard motor flush and run tank 10 wherein propeller 53 of marine outboard motor 50 is placed within the confines of flush trough member 20 of marine outboard motor flush and run tank 10 (in step S1). In order to place propeller 53 within the confines of flush trough member 20, propeller 53 may be rotated upward so that flush trough member 20 is positioned under propeller 53. After flush trough member 20 is positioned in place, propeller 53 is then rotated downward in a conventional manner and placed within the confines of flush trough member 20. The fluid line 34 is coupled to female coupler 31 via male coupler 33 (in step S2). Cap member 42 is fixedly coupled to fluid outlet conduit 41 (in step S3). The organic detergent or the like is poured into flush trough member 20 (in step S4). After pouring the organic detergent or the like into flush trough member 20, flush trough member 20 is filled with fresh water via fluid inlet means 30 until the water level reaches predetermined marker level 25 (in step S5). After the water reaches predetermined marker level 25, marine outboard motor 50 is started and placed in neutral (in step S6). As marine outboard motor 50 is in operation, the mixture of fresh water and organic detergent is siphoned into the coolant system of marine outboard motor 50 (in step S7) and flows therein. As said mixture flows through said coolant system salt, silt and other material, as well as said mixture, are purged from said coolant system (in step S8). Inspecting the purged mixture from the coolant system (in step S9). After a sufficient amount of the mixture of organic detergent and water has flowed through the coolant system, the user or mechanic opens fluid outlet means 40 by removing cap member 42 (in step S10). Said mixture, salt, silt and other material purged from marine outboard motor 50 exits flush trough member 20 via fluid outlet conduit 41 (in step S11) thereby flushing the mixture, salt, silt and other material from flush trough member 20. Simultaneously, the fresh water is replenished within flush trough member 20 such that the fresh water level is maintained at predetermined marker level 25 (in step S12). By visual inspection, the fresh water and/or mixture having salt, silt and other material mixed therein is monitored (in step S13) to determine the amount of salt, silt and other material being purged from said coolant system (in step S14). Depending on the amount of salt, silt and other material being purged from said coolant system, more organic detergent or the like may be added (in step S15) to the replenished fresh water (in step S12). Steps S7–S15 are repeated until the fresh water and/or mixture is determined to be substantially clear (in step S16).

Continuously flushing the purged fresh water and/or said mixture having silt, salt and other material mixed therein from flush trough member 20 via fluid outlet means 40, the water and/or said mixture within flush trough member 20 does not become stagnant and dirty thereby enhancing the flushing process.

It is noted that the embodiment of the method of flushing a marine outboard motor and marine outboard motor flush and run tank for carrying out said method described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A method of flushing an outboard marine motor using a marine outboard motor flush and run tank wherein the marine outboard motor flush and run tank comprises a flush trough member, fluid inlet means and fluid outlet means, said method of flushing an outboard marine motor comprising the steps of:

(a) placing a propeller member of the outboard marine motor into the confines of the fluid trough member;

(b) coupling a fluid line to the fluid inlet means;

(c) coupling a cap member to the fluid outlet means;

(d) pouring an organic detergent into the fluid trough member;

(e) filling the fluid trough member with fresh water via the coupled fluid line;

(f) starting said outboard marine motor;

(g) siphoning a mixture of said organic detergent and said fresh water into a coolant system of said outboard marine motor;

(h) purging said mixture from said coolant system into said fluid trough member;

(i) inspecting the purged mixture;

(j) opening the fluid outlet means;

(k) flushing from the fluid outlet means the purged mixture having salt, silt and other material mixed therein;

(l) simultaneous to step (k), replenishing the fresh water in the flush trough member;

(m) maintaining a fresh water level at a preferred level;

(n) monitoring the mixture for the salt, the silt, and the other material; and (o) repeating steps (g)–(n) until the mixture is substantially clear.

2. The method of claim 1, further comprising the step of adding organic detergent to the replenished fresh water in response to the monitoring of step (n) if a substantial amount of the salt, silt and the other material is mixed within the mixture.

3. The method of claim 1, wherein the step of (a) further comprises the steps of:

(i) rotating the propeller member upward;

(ii) positioning the marine outboard motor flush and run tank under the propeller member; and (iii) rotating the propeller member downward into the confines of the flush trough member.

4. The method of claim 1, wherein the step of (n) further comprises monitoring the amount of salt, silt and other material purged from the coolant system.

5. The method of claim 4, wherein in response to the amount of monitored salt, silt and other material purged from the coolant system, adding organic detergent to the replenished fresh water.

6. The method of claim 1, wherein the step of (f) further comprises placing the outboard marine motor in neutral.

7. A method of flushing an outboard marine motor of salt, silt and other material using a marine outboard motor flush and run tank wherein the marine outboard motor flush and run tank comprises a flush trough member, fluid inlet means, fluid outlet means and carry transport means, comprising the steps of:

(a) transporting the marine outboard motor flush and run tank via said carry transport means to the outboard marine motor;

(b) placing a propeller member of the outboard marine motor into the confines of a fluid trough member;

(c) coupling a fluid line to a fluid inlet means;

(d) coupling a cap member to a fluid outlet conduit;

(e) pouring an organic detergent into the fluid trough member;

(f) filling the fluid trough member with fresh water;

(g) starting said outboard marine motor;

(h) siphoning a mixture of said organic detergent and said fresh water into a coolant system of said outboard marine motor;

(i) purging said mixture from said coolant system into said fluid trough member;

(j) inspecting the purged mixture;

(k) opening the fluid outlet conduit;

(l) flushing from the fluid outlet means the purged mixture having salt, silt and other material mixed therein;

(m) simultaneous to step (I), replenishing the fresh water in the flush trough member;

(n) maintaining a water level at a preferred level;

(o) monitoring the mixture for the salt, the silt and the other material; and (p) repeating steps (h)–(o) until the mixture is substantially clear.

8. The method of claim 7, further comprising, after the step of (o), adding organic detergent to the replenished fresh water in response to the monitoring step (o).

9. The method of claim 7, wherein the step of (b) further comprises the steps of:

(i) rotating the propeller member upward;

(ii) positioning the marine outboard motor flush and run tank under the propeller member; and (iii) rotating the propeller member downward into the confines of the flush trough member.

10. The method of claim 7, wherein the step of (o) further comprises monitoring the amount of salt, silt and other material purged from the coolant system.

11. The method of claim 10, wherein in response to the amount of monitored salt, silt and other material purged from the coolant system, adding organic detergent to the replenished fresh water.

12. The method of claim 7, wherein the step of (g) further comprises placing the outboard marine motor in neutral.

* * * * *